United States Patent [19]

Louzecky

[11] 3,945,775

[45] Mar. 23, 1976

[54] ROTARY COMBUSTION ENGINE DAMPED APEX SEAL

[75] Inventor: Paul J. Louzecky, Troy, Mich.

[73] Assignee: General Motors Corporation, Detroit, Mich.

[22] Filed: Oct. 15, 1974

[21] Appl. No.: 514,757

[52] U.S. Cl. ..... 418/113; 277/DIG. 9; 188/1 B

[51] Int. Cl.[2] ..... F01C 19/02; F04C 27/00

[58] Field of Search ..... 418/113, 115, 120–124; 277/DIG. 9; 188/1 B

[56] References Cited

FOREIGN PATENTS OR APPLICATIONS 1,194,210 6/1965 Germany ..... 418/113

1,198,149 8/1965 Germany ..... 418/113

*Primary Examiner*—John J. Vrablik

*Attorney, Agent, or Firm*—Ronald L. Phillips

[57] ABSTRACT

In an internal combustion rotary engine having a rotor housing with a rotor having apex seals sliding on the rotor housing there is provided a dynamic damper secured to each apex seal for damping apex seal vibrations caused by the rotor housing as excited by the engine firing cycle and there is also provided a dynamic damper secured to each apex seal for damping apex seal vibrations caused by apex seal bending.

6 Claims, 6 Drawing Figures

ROTARY COMBUSTION ENGINE DAMPED APEX SEAL

This invention relates to rotary combustion engine damped apex seals and more particularly to dynamic dampers damping apex seal vibration caused by the rotor housing as excited by the engine firing cycle and also apex seal vibrations caused by apex seal bending.

In certain rotary combustion engines it has been found that the apex seals vibrate with substantial amplitudes, this being confirmed by the observation of chatter marks on the rotor housing and surface scratches on the sides of the apex seals. Since the vibration will permit leakage past the apex seals in addition to the deleterious affects on the relatively moving parts, it is very desirable that any substantial apex seal vibrations either be eliminated or substantially reduced and by simple means readily suited to mass production. In approaching this problem, I have found that one of the major difficulties lay in finding the actual cause of the troublesome vibrations since arriving at the most efficient vibration damper is predicated on treating the exact ill.

In the rotary combustion engines which I have investigated, the apex seals are typically located on the rotor and pushed against the rotor housing surface by a flat spring under each seal. When the engine is running, the apex seals are held in place by this spring force and by the centrifugal and gas forces. I have found that with such an arrangement the apex seals are dynamically unstable and that it is principally the gas firing force that sets up an undulating rotor housing vibration which in turn excites the apex seals and results in chatter marks on the rotor housing. There are, however, a number of other sources of seal excitation such as bending vibration of the seal due to its own weight, vibration resulting from gas pressure, and vibration resulting from the spring or the compressibility of the seal material itself when acted upon by the gas force. However, I have found that the rotor housing vibration and the seal bending vibration which have relatively low and high natural frequencies, are the two major sources of excessive apex seal motion and of these two it is most important to dampen the apex seal motion caused by the rotor housing vibration resulting from the engine firing cycle. Having diagnosed the major causes of apex seal vibration, I then found that simple dynamic dampers in the form of differently tuned free-ended beams can be secured to each of the apex seals to provide nodal drives that dampen out the low frequency apex seal vibration caused by rotor housing vibration and the high frequency apex seal vibration caused by apex seal bending.

An object of the present invention is to provide a new and improved rotary combustion engine damped apex seal.

Another object is to provide in a rotary combustion engine a dynamic damper mounted on each apex seal that dampens the apex seal vibration caused by rotor housing vibration from the engine firing cycle.

Another object is to provide in a rotary combustion engine a dynamic damper mounted on each apex seal that dampens apex seal vibration caused by apex seal bending.

Another object is to provide in a rotary combustion engine a low frequency dynamic damper mounted on each apex seal that dampens apex seal vibration caused by rotor housing vibration from the engine firing cycle and a high frequency dynamic damper mounted on each apex seal that dampens apex seal vibration caused by apex seal bending.

These and other objects of the present invention will become more apparent from the following description and drawing in which.

Figure 1:
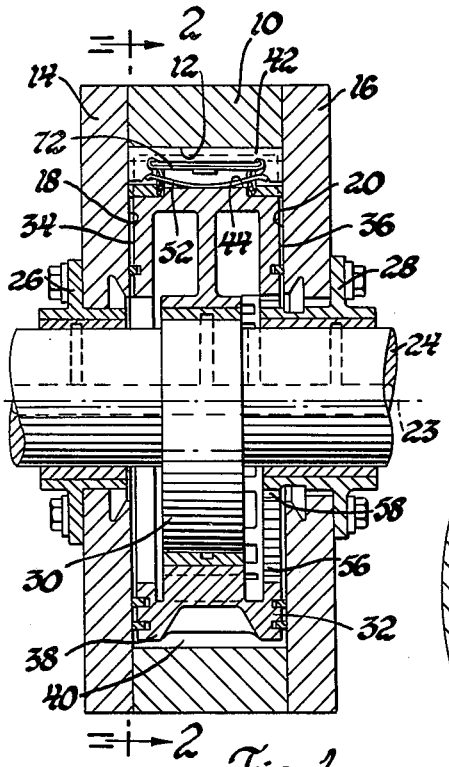
FIG. 1 is a side elevation with parts in section of a rotary combustion engine having damped apex seals according to the present invention.
Figure 2:
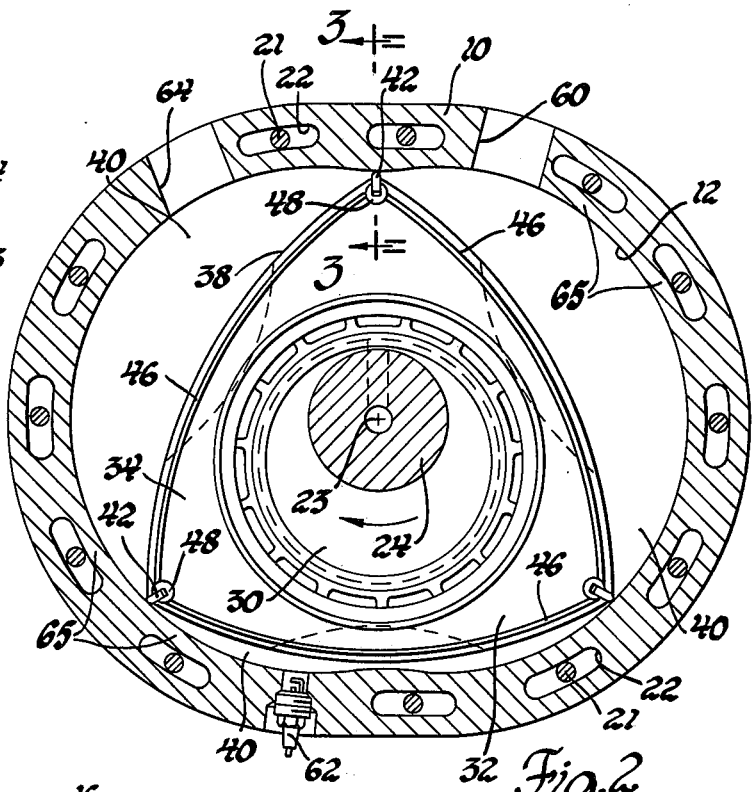
FIG. 2 is a view taken along the line 2—2 in FIG. 1.
Figure 3:
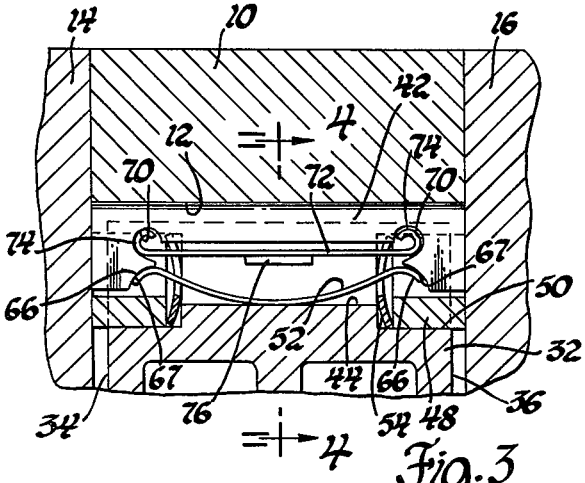
FIG. 3 is an enlarged view taken along the line 3—3 in FIG. 2.
Figure 5:
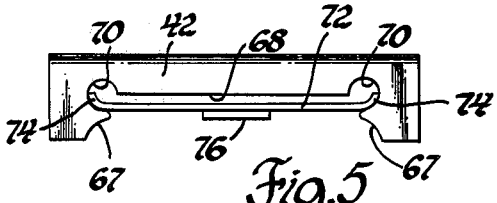
FIG. 5 is a side view of the damped apex seals.
Figure 4:
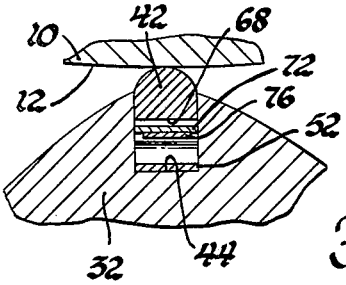
FIG. 4 is a view taken along the line 4—4 in FIG. 3.

The damped apex seals according to the present invention are shown in use in a rotary combustion engine of the planetary type shown in FIGS. 1 and 2. The engine comprises a housing which in a single rotor arrangement has basically three parts, namely a rotor housing 10 having an inwardly facing peripheral surface or wall 12 and a pair of end housings 14 and 16 having parallel, oppositely facing, spaced inner end walls 18 and 20, respectively. The housing parts are secured together by bolts 21 extending through coolant passages 22 in the rotor housing with the inner housing walls 12, 18 and 20 cooperatively provide a cavity. As shown in FIG. 2, the peripheral wall 12 has the shape of a two-lobe epitrochoid or curve parallel thereto whose center line is indicated at 23. A crankshaft 24 extends through the cavity and is rotatably supported in collars 26 and 28 that are bolted to the end housings 14 and 16 as shown in FIG. 1. The crankshaft 24 has an eccentric 30 located in the cavity and a rotor 32 is rotatably mounted on the eccentric. The rotor 32 has the general shape of a triangle with two parallel side walls 34 and 36 at right angles to the rotor axis which face and run close to the end walls 18 and 20, respectively, and a peripheral wall 38 having three arcuate outer faces which face the peripheral wall 12 and cooperate therewith and with the end walls 18 and 20 to define three variable volume working chambers 40. Sealing of the three chambers 40 is effected by sealing means comprising three one-piece apex seals 42 each of which is mounted in an axially extending slot 44 that is located at each apex or corner of the rotor and extends the width thereof. Three arcuate side seals 46 are mounted in accommodating grooves in each rotor side and extend adjacent the rotor faces between two of the apex seals 42. Three cylindrical corner seals 48 are mounted in cylindrical holes 50 at the opposite ends of the apex seal slots 44 and provide sealing between the adjacent ends of two side seals and one apex seal as best shown in FIG. 3. Each of the apex seals 42 is biased outwardly by a leaf spring 52 to engage the peripheral wall 12 while each of the corner seals 48 is biased by a spring 54 to engage the respective end wall. Each of the side seals 46 is also biased by a spring, not shown, to engage the respective end wall.

With the two-lobe peripheral wall 12 and three corner rotor 32, each of the working chambers 40 sequentially expands and contracts between minimum and maximum volume twice during each revolution in fixed relation to the housing by forcing the rotor to rotate at one-third the speed of the crankshaft in a certain manner. This is accomplished by gearing comprising an internal tooth rotary phasing gear 56 which is fixed to the rotor side 36 concentric with the rotor axis. The gear 56 meshes with an external tooth annular stationary phasing gear 58 which is freely received about and is concentric with the crankshaft 24 and is made stationary by being fixed to the inboard end of the right-hand collar 28 as shown in FIG. 1. The gear 56 has 1½ times the number of teeth as the gear 58 to provide the required speed ratio of 3:1 between the crankshaft and the rotor.

A combustible air-fuel mixture from a suitable carburetor and manifold arrangement, not shown, is made available to each working chamber 40 through an intake port 60 in the rotor housing 10 through the peripheral wall 12, the apex seals 42 thus passing over the intake port which is arranged so as to be open to the chambers as they expand in an intake phase as the rotor turns in the direction of the arrow in FIG. 2. A spark plug 62 is mounted in the rotor housing 12 with its electrodes exposed to the passing working chambers and ignites the mixture when the rotor faces are in the vicinity of top-dead-center, there being provided a suitable ignition system, not shown, for applying voltage to the spark plug at the proper time. Upon ignition of the mixture, the peripheral wall 12 takes the reaction forcing the rotor to continue rotating while the gas is expanding. The leading apex seal 42 of each of the working chambers eventually traverses an exhaust port 64 in the peripheral wall of the rotor housing whereby the exhaust products are then expelled to complete the cycle.

In the engine structure thus far described it has been found that the apex seals are dynamically unstable and will vibrate as a result of a number of sources of excitation, the seal since it is dynamically unstable being capable of being excited by almost any vibration that would result in seal motion. For example, the apex seals can vibrate as a result of the gas pressure acting as a spring on the bottom of these seals, such excitation producing apex seal vibration at a low frequency of long duration as the result of expansion pressure and a high frequency of short duration as the result of firing pressure. Furthermore, the seal material itself has a certain compression or spring rate and when acted upon by the gas force will thus be excited to vibrate, such vibration being dependent upon the modulus of elasticity of the apex seal material. The apex seals also have their own vibrating natural frequency with the first mode of bending vibration for the seal determined by the seal deflection due to its own weight. The apex seal also has a rocking mode of vibration of substantially higher frequency and a third mode where the apex seal vibrates as a free-ended beam with a natural frequency intermediate the bending and rocking mode frequencies. Apart from the apex seal vibrations noted above, I have found that the engine firing cycle excites vibration of the rotor housing which in turn excites the apex seals, the unsupported inner peripheral wall spans 65 under the coolant passages 22 vibrating as beams with fixed ends. I have further found that the vibrating housing spans produced by the firing pressure are the predominant factor in causing excessive apex seal vibration, the housing spans typically having a relatively low frequency, e.g. about 100 cps in one actual engine. Secondarily, the bending vibration of the seal as determined by its deflection due to its own weight appears to be the next greatest cause of excessive apex seal vibration, the natural bending frequency of the seals being a much higher frequency than the rotor housing spans, e.g. about 3600 cps in the same engine examined.

In the present invention, I have provided a simple dynamic damper which secures to the apex seals and is tuned to damp the predominant low frequency vibration of the seal excited by rotor housing vibration from the engine firing cycle. Furthermore, I have supplemented this damping system with another dynamic damper similar to the first but separately tuned to damp the higher frequency apex seal bending vibration. In the existing apex seal arrangement, I have taken advantage of the relative arrangement of the apex seals and their springs wherein each of the springs 52 is seated at its middle on the bottom of the apex seal slot 44 and has curved ends 66 engaging the curved ends 67 of a recess 68 in the bottom of the apex seal as best shown in FIG. 3. To accommodate my dynamic dampers, the recess 68 is extended upward along its length and is formed with sockets 70 at its opposite ends above the spring seats 67. This permits the simple installation of a spring type low frequency dynamic damper 72 in the form of a metal leaf with rectangular cross-section. The damper 72 is mounted in the extension of the recess 68 between the apex seal spring 52 and the upwardly displaced bottom of the apex seal 42 and has upwardly curved ends 74 which are received in the sockets 70 whereby the damper is thus secured to the apex seal and is positively held or trapped thereon when the seal is mounted in the apex seal slot. As a result, the damper 72 is freely supported in bending at its opposite ends directly on the apex seal, i.e. is mounted as a free-ended beam on the seal. The natural frequency of the low frequency dynamic damper 72 is made to be equal to or about that of the natural frequency of the rotor housing spans by proper selection of its weight, its dimensions, its modulus of elasticity and its inertia. Furthermore, a weight 76 can be added as shown to lower the spring's natural frequency, this added weight to be effective having a mass of about 10–20% of the mass of the apex seal. As a result, when the apex seal is excited by the rotor housing during the engine firing cycle, the apex seal will move in one direction and the dynamic damper 72 will move in the opposite direction, i.e. 180° out of phase therewith and there will be effected a so-called "nodal drive" which is known to be effective to eliminate or dampen vibrations.

Figure 6:
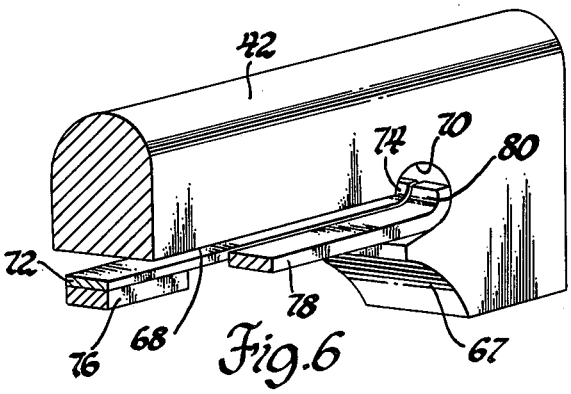
FIG. 6 is an enlarged perspective view of the apex seals with two dynamic dampers secured thereto.

Then for the apex seal vibrations at the higher frequencies as caused by apex seal bending from the gas force as determined by the seal deflection due to its own weight, there is provided another dynamic damper 78 that is similar to and fits along side the low frequency damper with its curved ends 80 also freely supported in the sockets 70 in the apex seal as shown in FIG. 6. The high frequency damper 78 is made stiffer than the low frequency damper 72 to tune to the high frequency apex seal bending vibrations, this being readily accomplished for example by making the free-ended beam substantially thicker as shown. As a result, there is then provided a high frequency nodal drive to eliminate or dampen the high frequency apex seal vibrations of seal bending.

Thus, there has been provided simple and efficient dynamic damping of the apex seal vibration by using a free-ended beam damper tuned with or without weights to the natural frequency of the rotor housing spans to dampen the predominant apex seal vibration of low frequency. Furthermore, it has been shown that a similar type damper tuned to the higher frequency of the secondarily important apex seal bending vibration can also be employed along side the major damping device and all within a very confined space. It will also be appreciated that with the free-ended beam damper provided, its natural or damping frequency is more predictable than for example that of a fixed-end beam arrangement.

The above described embodiments are illustrative of the invention which may be modified within the scope of the appended claims.

I claim:

1. An internal combustion rotary engine comprising a rotor housing, a rotor having apex seals sliding on said rotor housing as the rotor rotates, and damper means secured to each said apex seal having a natural frequency substantially equal to the frequency of said rotor housing excited by the engine firing cycle whereby there is effected a nodal drive to dampen apex seal vibration caused by said rotor housing.

2. An internal combustion rotary engine comprising a rotor housing, a rotor having apex seals sliding on said rotor housing as the rotor rotates, and a free-ended beam freely secured at opposite ends to each said apex seal having a natural frequency substantially equal to the frequency of said rotor housing excited by the engine firing cycle whereby there is effected a nodal drive to dampen apex seal vibration caused by said rotor housing.

3. An internal combustion rotary engine comprising a rotor housing, a rotor having apex seals sliding on said rotor housing as the rotor rotates, and damper means secured to each said apex seal having a natural frequency substantially equal to the bending frequency of the apex seal determined by its own weight whereby there is effected a nodal drive to dampen apex seal vibration caused by apex seal bending.

4. An internal combustion rotary engine comprising a rotor housing, a rotor having apex seals sliding on said rotor housing as the rotor rotates, and a free-ended beam with a center weight freely secured at opposite ends to each said apex seal having a natural frequency substantially equal to the bending frequency of the apex seal determined by its own weight whereby there is effected a nodal drive to dampen apex seal vibration caused by apex seal bending.

5. An internal combustion rotary engine comprising a rotor housing, a rotor having apex seals sliding on said rotor housing as the rotor rotates, first damper means secured to each said apex seal having a natural frequency substantially equal to the frequency of said rotor housing excited by the engine firing cycle whereby there is effected a nodal drive to dampen apex seal vibration caused by said rotor housing, and second damper means secured to each said apex seal having a natural frequency higher than the natural frequency of said first damper means and substantially equal to the bending frequency of the apex seal determined by its own weight whereby there is effected a nodal drive to dampen apex seal vibration caused by apex seal bending.

6. An internal combustion rotary engine comprising a rotor housing, a rotor having apex seals sliding on said rotor housing as the rotor rotates, a free-ended beam freely secured at opposite ends to each said apex seal having a natural frequency about equal to the frequency of said rotor housing excited by the engine firing cycle whereby there is effected a nodal drive to dampen apex seal vibration caused by said rotor housing, and a free-ended beam with a center weight freely secured at opposite ends to each said apex seal having a natural frequency higher than the natural frequency of said first mentioned free-ended beam and substantially equal to the bending frequency of the apex seal determined by its own weight whereby there is effected a nodal drive to dampen apex seal vibration caused by apex seal bending.

* * * * *